United States Patent [19]

Saunders et al.

[11] 4,447,797

[45] May 8, 1984

[54] INSULATED CONDUCTOR HAVING ADHESIVE OVERCOAT

[75] Inventors: Howard E. Saunders, Murrysville; Dean C. Westervelt, Bullskin; Irving N. Elbling, Pittsburgh, all of Pa.

[73] Assignee: Westinghouse Electric Corp., Pittsburgh, Pa.

[21] Appl. No.: 434,100

[22] Filed: Oct. 12, 1982

[51] Int. Cl.[3] ..... H01B 7/02; H01F 27/32

[52] U.S. Cl. ..... 336/205; 174/110 E; 174/120 SR; 428/383

[58] Field of Search ..... 428/375, 379, 383; 174/110 E, 110 SR, 120 SR; 336/205, 206

[56] References Cited

U.S. PATENT DOCUMENTS

| | | | |
|---|---|---|---|
| 3,619,259 | 11/1971 | Wright | 361/323 |
| 3,911,202 | 10/1975 | Stine et al. | 174/120 SR |
| 4,032,673 | 6/1977 | Schroeter et al. | 427/54 |
| 4,088,809 | 5/1978 | Elbling et al. | 428/379 |
| 4,117,361 | 9/1978 | Smith et al. | 174/120 SR X |
| 4,127,695 | 11/1978 | Hirakawa et al. | 174/110 E X |
| 4,160,178 | 7/1979 | Smith et al. | 174/120 SR X |
| 4,184,001 | 1/1980 | Hildreth | 428/383 |
| 4,204,087 | 5/1980 | Lin et al. | 174/120 SR |
| 4,239,077 | 12/1980 | Dixon | 156/272 |
| 4,241,101 | 12/1980 | Saunders et al. | 523/403 X |
| 4,268,659 | 5/1981 | Bederke | 528/288 |
| 4,317,858 | 3/1982 | Sattler | 428/379 |
| 4,362,263 | 12/1982 | Kwiecinski | 174/110 E |

*Primary Examiner*—Lorraine T. Kendell

*Attorney, Agent, or Firm*—R. D. Fuerle

[57] ABSTRACT

Disclosed is a conductor coated with a fused and cured powder applied insulating coating over which is a coating of an ultraviolet B-stageable, thermally C-stageable liquid resin. The coating is cured to the B-stage and strands of the conductor are placed side-by-side. The coating is then cured to the C-stage which fuses the strands of the conductor into a solid mass. The adhesive coated conductors may be used to form transformer coils, transposed cables, or other articles.

9 Claims, 1 Drawing Figure

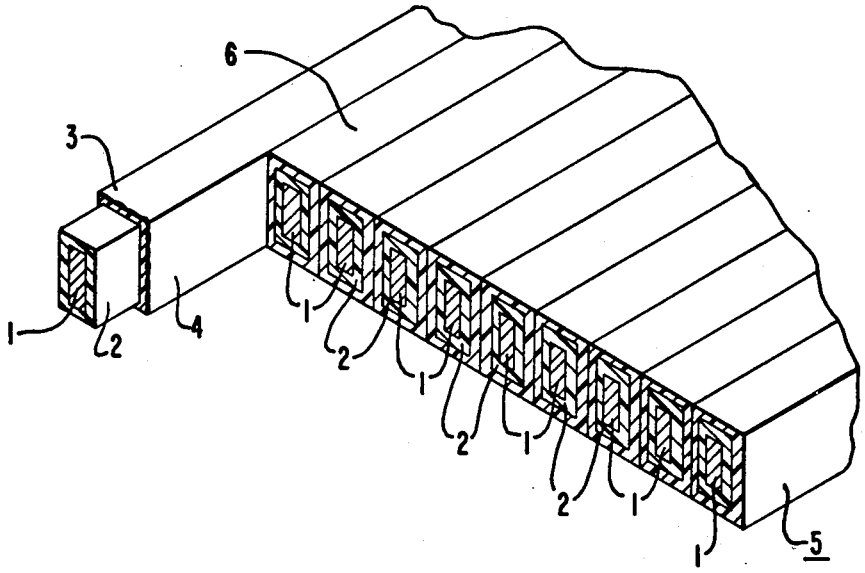
6
3
1
2
4
1
2
1
2
1
2
1
1
5

INSULATED CONDUCTOR HAVING ADHESIVE OVERCOAT

BACKGROUND OF THE INVENTION

Electrical failure of transformer coils, transposed cables, and other electrical equipment can occur when short circuit forces or mechanical abuse damage insulation. The mechanical strength of insulated coils and cables can be increased by bonding the individual insulated electrical conductors together into a single mass. This has been accomplished by placing adhesive coated paper in between the layers of conductors. However, while this increases strength and reduces insulation damage, it also increases the cellulosic content of the electrical apparatus. Cellulose is undesirable if certain dielectric fluids are present because they react with cellulose to produce compounds which increase the conductivity of the fluid. Another technique for forming a single mass out of multiple conductors is to cover the conductors with an adhesive either before or after the conductors have been juxtaposed. While this technique has also worked, it involves an additional step, and difficulties may be encountered in obtaining good adhesion between the insulation and the adhesive.

SUMMARY OF THE INVENTION

We have discovered a method of preparing an adhesively coated insulated conductor which can be bonded to itself to form a solid mass which is resistant to electrical stress and mechanical abuse. The adhesively coated conductor according to this invention can be made in a single pass in a manufacturing process that requires very little space. The adhesive overcoat can be rapidly cured to the B-stage with ultraviolet light (UV) which requires less energy than a thermal cure. It can then be easily thermally cured to C-stage (i.e., completely cured) once the conductors have been formed into a coil or cable. Since the overcoat is 100% solids no solvent is evolved during curing and thus problems of air pollution and the collection and containment of vaporized solvent are avoided. The adhesive coated conductor has an excellent shelf life and can be stored for long periods of time prior to use. The overcoat does not flake and adds to the insulating qualities of the undercoat.

While ultraviolet curable compositions are not meant to be cured by heat, we have found that such compositions can be very usefully adapted to producing adhesive coatings by only partially curing them with ultraviolet light and later completing the cure with heat. In spite of this unusual use of UV compositions, we have obtained excellent adherence between bonded conductors, and no adverse reactions have been observed that have lowered electrical or mechanical properties.

Surprisingly, we have discovered that the overcoat has a synergistic interaction with a powder coated undercoat in that the dielectric strength of the overcoat on top of the undercoat is greater than the sum of the dielectric strengths of the two coatings by themselves.

RELEVANT ART

U.S. Pat. Nos. 3,619,259 and 3,911,202 disclose UV polymerization of continuous films which may be used for the purpose of electrical insulation.

U.S. Pat. Nos. 4,184,001 and 4,268,659 disclose UV curable compositions specifically for use as insulation of electric wires.

U.S. Pat. No. 4,317,858 discloses a UV curable adhesive.

U.S. Pat. Nos. 4,032,673 and 4,239,077 disclose UV curable resins for use in transformer coils.

DESCRIPTION OF THE INVENTION

The accompanying drawing is an isometric view in section of a certain presently preferred embodiment of an insulated conductor having an adhesive overcoat according to this invention.

In the drawing, conductors 1 are covered with a powder-coated insulation 2 over which has been applied a liquid resin 3 which has been B-staged with ultraviolet light at 4. At 5, the B-staged resin on adjacent strands of the conductor has been C-staged forming a solid mass 6.

The conductor used in this invention may be of any material, though it is typically a metal such as copper or aluminum. The conductor may be round or rectangular wire or strip.

An insulating coating is applied over the conductor. The coating can be of almost any resin including epoxies, polyamides, polysulfones, polyester amides, and other resins. The coating is preferably an epoxy because those resins have the best combination of electrical, chemical, and mechanical properties for use in transformers. (See, for example, U.S. Pat. Nos. 4,088,809 and 4,241,101.) The coating must be applied by a powder coating technique such as a fluidized bed, an electrostatic fluidized bed, or an electrostatic spray gun. After the coating has been applied to the conductor, it is fully cured. The coating may be of any thickness but it is typically about 3 to about 8 mils. A description of a suitable powder coating process can be found in U.S. Pat. No. 4,127,695, herein incorporated by reference. Since the powder coating is typically cured by heat, it may be desirable to cool the coating in water or air prior to coating with the UV adhesive. Cooling may be desirable if the wire is to be wound on a spool before the UV adhesive is applied, but if the UV adhesive is to be applied immediately, it may be desirable to have the powder coated wire warm so as to aid in the flow of the viscous UV adhesive. However, the powder coated wire should not be so hot that it cures the UV adhesive to the C-stage. It is, of course, preferable to coat the powder coated wire with the UV adhesive immediately in order to avoid the extra steps of winding and unwinding the conductor.

The adhesive overcoat may be of any liquid resin which can be B-staged with ultraviolet light and thermally cured to the C-stage. This can be accomplished with an ultraviolet curable resin by only partially curing it to the B-stage and then completing the cure to the C-stage using heat. However, it is more desirable to use a specially prepared resin which has two components—a UV curable component and a heat-sensitive component. A two-component resin is easier to work with because the ultraviolet light can only cure it to the B-stage and thus it is not necessary to carefully control the exposure to ultraviolet light as it would be if the ultraviolet light could cure the resin all the way to the C-stage. An example of a two-component resin is given in Example 1, Composition A. Another suitable ultraviolet curable adhesive is described by F. A. Sattler in U.S. Pat. No. 4,317,858.

The adhesive overcoat must be a liquid, and it is preferably 100% solids to reduce air pollution and the cost of recovering solvents. Suitable resins include acrylated epoxies, cationic photo-initiated epoxies, thiol-polyene systems, and acrylo-urethanes. Acrylated epoxies are preferred as they have the best properties. A resin can be applied by reverse roller coating, by dipping and passing through a die or a wiper of leather or felt, or other technique. Reverse roller coating is preferred as it produces a thinner and more easily controlled coating.

After the adhesive overcoat has been applied, it is cured to the B-stage. The B-stage is the point at which the coating becomes dry, tack free, and nonblocking. This occurs when the resin is cured past its gelation point. The cure to the B-stage is accomplished using ultraviolet light of a frequency and intensity which depend upon the particular composition used and the speed with which the conductor passes under the light. After the adhesive overcoat has been cured to the B-stage, the conductor can be wound onto reels or it can be used immediately. The B-staged coating can be of any thickness, but it is preferably about 0.25 to about 1½ mils as a thinner coating has a poor bond strength and a thicker coating uses too much space.

In the next step of this invention strands of the conductor are placed side-by-side. The conductors with the adhesive overcoat may be used to form transformer coils, motor coils, transposed cables, or other structures where the fusion of adjacent conductors into a solid mass would be desirable.

In the final step of this invention the adhesive overcoat is heated to complete its cure to the C-stage. The temperature and time required to complete the cure will depend upon the particular adhesive overcoat composition that is used.

The following examples further illustrate this invention.

EXAMPLE 1

A 0.114×0.289 inch rectangular aluminum wire was powder coated with an epoxy powder coating resin described in the example of U.S. Pat. No. 4,241,101 or 4,088,809, herein incorporated by reference. The powder coating was cured in a wire tower at a speed of 10–50 ft/min and a tower temperature of 300°–450° C. and had a thickness of 3 to 8 mils. After the powder coated wire had been fused and cured, short lengths of the powder coated wire were cut and an adhesive overcoat was brushed onto the wire by hand and cured to the B-stage under ultraviolet radiation. The following ultraviolet curable overcoats were used.

| Ingredients | Composition (parts by weight) A | B | C |
|---|---|---|---|
| Solid diglycidyl ether of bisphenol A sold by Dow Chemical Co. as "DER 662" | 55.3 | 56.4 | 55.7 |
| Tetraethylene glycol diacrylate | 33.0 | 33.7 | 33.6 |
| Triethanolamine borate in phenoxyethyl acrylate sold by Westinghouse as "WT-17" | 8.3 | 8.4 | 8.2 |
| Isopropyl benzoin ether sold by Stouffer as "V-10" photoinitiator | 1.3 | 1.4 | — |
| Isobutyl benzoin ether sold by Stouffer as "V-30" photoinitiator | — | — | 1.4 |
| Fluorinated alkyl ester sold by 3M as "FC-430" Surfactant | 2.1 | — | 1.1 |
| Picric acid | — | — | 0.01 |

Three pieces of the adhesive coated wire were clamped together overlapping about ¼ inch and were heated to 130° for six hours in either air or in kerosene. After cooling the bonded samples were subjected to tensile shear testing (double lap shear testing) at temperatures from 25° to 175° C. The results are given in the following table.

| Test Temp. (°C.) | Overcoat: Composition A Bld. 3.0–4.0 | Composition B Bld. 3.0–4.0 | Composition C Bld. 2.5–4.0 |
|---|---|---|---|
| Cured in Kerosene | | | |
| 25 | | | 2663 |
| Cured in Air | | | |
| 25 | 1276 | 1757 | 2000, 2708 |
| 100 | | | 2486 |
| 125 | | | 2351 |
| 150 | | | 1537 |
| 175 | | | 638 |

This example shows that UV sensitive adhesives can be formulated and applied to powder coated conductors with good tensile shear strengths at temperatures as high as 175° C. It also shows that bonding in kerosene does not adversely affect the bond strength of these adhesives.

EXAMPLE II

Rectangular aluminum wire (0.114×0.289 in) was coated with the powder disclosed in U.S. Pat. No. 4,241,101 in a wire tower, then cured and spooled. Short lengths (~12 in) were cut and straightened, then coated manually with two different UV sensitive adhesives.

| | |
|---|---|
| Composition A | |
| "DER 662" epoxy resin | 47.1 pbw |
| Limonene dioxide | 31.3 pbw |
| Methyl tetrahydrophthalic anhydride | 15.7 pbw |
| Aliphatic triglycidyl ether sold by Celanese as "5044" epoxy resin | 2.4 pbw |
| triaryl sulfonium hexafluoro phosphate sold by 3M as "FC-508" photoinitiator | 5.1 pbw |
| Chromium acetylacetonate | 0.04 pbw |
| Composition B | |
| "DER 662" epoxy resin | 45.5 pbw |
| 1,6-hexanediol diacrylate | 6.9 pbw |
| 2-ethoxyethyl acrylate | 9.2 pbw |
| Butyl glycidyl ether sold by Ciba Geigy as "RD-1" diluent | 5.0 pbw |
| Diglycidyl ether of neopentyl glycol | 5.0 pbw |
| Methyl tetrahydrophthalic anhydride | 15.0 pbw |
| "V-30" photoinitiator | 0.64 pbw |
| Chromium acetylacetonate | 0.04 pbw |

Wires overcoated with the above composition and B-staged were overlapped in pairs by a distance of 1 in. along their long axes and subjected to a pressure of 50 psi. The pairs were placed in a laboratory air circulating oven for 6 hours at 130° C. to C-stage the adhesive overcoats. After cooling, the bond pairs were tested for lap shear strength at 150° C. The results were as follows (average of 5 samples):

| Overcoat | Lap Shear Strength (psi) |
|---|---|
| Composition A | 58 |
| Composition B | 154 |

After the adhesive had been B-staged, some samples were shelf aged for a period of 3 months.

The tensile shear test as described in Example I was repeated. The results were as follows (average of 5 samples):

| Overcoat | Lap Shear Strength (psi) |
|---|---|
| Composition A | 51 |
| Composition B | 150 |

These results show that the UV adhesives of this invention can be applied to powder coated conductors and can retain their tensile shear strength (single lap shear test) after shelf aging for periods of at least 3 months.

EXAMPLE III

Samples of 0.064×0.258 inch copper wire were coated with 4 mils of epoxy powder coating as in Example I. The samples were then coated with various adhesive overcoats including the same epoxy powder coating, Formvar and a UV composition which consisted of Acrylated epoxy—55.5% (50% phenoxyethyl acrylate);

UV catalyst—2.5%;

Hexamethoxymethyl melamine (sold by American Cyanamid as "Cymel 303")—6.4%;

Phenoxyethyl acrylate—6.4%;

Vinyl acetate—8.4%;

Epoxy novolac—6.4%;

"WT-17"—6.0%;

Benzodimethyl melamines—0.18% and blocked acrylated urethane—6.2%;

Tetraethylene glycol diacrylate—1.8%;

Catalyst 10-10 (manufactured by American Cyanamid)—0.03%;

Iron or chromium acetylacetonates—0.03%.

The ultraviolet adhesive overcoat was prepared in the following manner:

Three six inch samples were overlapped one inch and clamped together under a pressure of 10 psi. Beam tests were also performed on the samples. In a beam test, two beams 5 inches apart are placed under a stack of 5 wires bonded together and a third beam is pressed downward between the other two beams. The psi required to produce a failure are measured. The following table shows the results.

| Adhesive | Test Temperature R. T. | Test Temperature 120° C. |
|---|---|---|
| Powder Coated Epoxy | 480 | 650 |
| Formvar* | 830 | 430 |
| UV | 872 | 736 |

*a wire enamel which contains polyvinyl formyl as a base resin. Other resins such as phenols, blocked isocyanates, and melamine formaldehyde are added, depending on the supplier.

These results show that correctly formulated UV adhesives have beam shear strengths comparable to those of either powdered or solvent based adhesives when applied over powder coated conductors.

EXAMPLE V

A further benefit of using UV sensitive overcoats is a marked improvement in electric strength. A spool of 0.064×0.258 copper rectangular wire was coated with powder manufactured by HYSOL and finely ground.

Example I was repeated and the dielectric strength of samples with and without UV overcoat were tested. The following table gives the results on 0.064 by 0.258 inch rectangular copper wire.

| Undercoat | Overcoat | Dielectric (K. Volts) 1st sample #1 | #2 | #3 | #4 | 2nd sample #5 | #6 | #7 | #8 | Build (Mils) |
|---|---|---|---|---|---|---|---|---|---|---|
| A diglycidyl ether of bisphenol A epoxy power cured with trimellitic anhydride sold by 3M Company | None | 4.2 | 3.5 | 4.1 | 2.2 | 3.8 | 3.8 | 4.6 | 3.4 | Side 1 - 4.5 Powder Thickness |
| | | avg. | 3.5 | | Kv, avg. Kv/mil = 0.82 | | | | | Side 2 - 4.0 Powder Thickness |
| | UV Adhesive | 4.8 | 4.5 | 4.9 | 4.2 | 3.7 | 4.2 | 4.3 | 4.5 | Side 1 - 4.0 Total Thickness |
| | | avg. | 4.4 | | Kv, avg. Kv/mil = 1.11 | | | | | Side 2 - 3.9 Total Thickness |
| Diglycidyl ether of bisphenol A epoxy power (See U.S. Pat. No. 4,241,101) | None | 2.8 | 0.3 | 2.0 | 4.8 | 3.9 | 0.6 | 4.7 | 3.9 | Side 1 - 3.0 |
| | | avg. | 3.0 | | Kv, avg. Kv/mil = 0.89 | | | | | Side 2 - 3.7 |
| | UV Adhesive | 4.5 | 4.5 | 5.0 | 5.4 | 4.9 | 5.4 | 5.0 | 3.6 | Side 1 - 3.5 |
| | | avg. | 4.9 | | Kv, avg. Kv/mil = 1.30 | | | | | Side 2 - 4.1 |

This experiment shows that the addition of a UV-sensitive adhesive overcoat increases the electric strength in Kv/mil of a powder coated conductor by at least 20%. This is believed to be due to the initially liquid UV sensitive filling any voids or thinner areas in the powder coating.

EXAMPLE VI

Three samples of rectangular aluminum wire coated with the same powder used in Example I were dipped into a UV sensitive resin comprised of:

| | |
|---|---|
| "DER 662" epoxy resin | 502.5 g |
| "WT-17" | 75.0 |
| Tetraethylene glycol diacrylate | 200.0 |
| Ethyl hexyl acrylate | 150.0 |
| 2-hydroxy ethyl acrylate | 37.5 |
| "V-10" photoinitiator | 3.75 |
| Tert-butyl perbenzoate | 3.75 |

Excess resin was wiped off and the coating was irradiated for 8 minutes under a source of ultraviolet light.

After the irradiation, the coating was dry to the touch and measured 3.5 mil (addition to the thickness).

The three samples were pressed together under nominal spring pressure (from a bulldog clip) at 150° C. for 1½ hours.

A double lap-shear test gave a test value of 184 lbs. on the two adhered areas of 0.350×0.258 in., equivalent to 1020 psi.

We claim:

1. An article comprising a conductor coated with a fused and cured resin powder applied insulating coating, over which is a coating of an ultraviolet B-stageable, thermally C-stageable liquid resin.

2. An article according to claim 1 wherein said conductor is an aluminum or copper wire.

3. An article according to claim 1 wherein said insulating coating is an epoxy resin.

4. An article according to claim 1 wherein said insulating coating is about 3 to about 8 mils thick.

5. An article according to claim 1 wherein said liquid resin is an acrylated epoxy.

6. An article according to claim 1 wherein said liquid resin is solventless.

7. An article according to claim 1 wherein said coating has been cured to the B-stage with ultraviolet light.

8. An article according to claim 7 wherein strands of said conductor are placed side-by-side and said coating is cured to the C-stage.

9. An article according to claim 8 in the form of a transformer coil.

* * * * *